US008500387B2

(12) United States Patent
Trifunovic

(10) Patent No.: US 8,500,387 B2
(45) **Date of Patent: *Aug. 6, 2013**

(54) ELECTRONIC PARALLEL LIFT AND RETURN TO CARRY OR FLOAT ON A BACKHOE LOADER

(75) Inventor: Boris Trifunovic, Durango, IA (US)

(73) Assignee: Deere & Company, Moline, IL (US)

( * ) Notice: Subject to any disclaimer, the term of this patent is extended or adjusted under 35 U.S.C. 154(b) by 732 days.

This patent is subject to a terminal disclaimer.

(21) Appl. No.: 12/664,673

(22) PCT Filed: Jun. 22, 2007

(86) PCT No.: PCT/US2007/014604

§ 371 (c)(1),
(2), (4) Date: May 21, 2010

(87) PCT Pub. No.: WO2008/153532

PCT Pub. Date: Dec. 18, 2008

(65) Prior Publication Data

US 2010/0226744 A1 Sep. 9, 2010

(30) Foreign Application Priority Data

Jun. 15, 2007 (WO) ..... PCT/US2007/014071
Jun. 15, 2007 (WO) ..... PCT/US2007/014196

(51) Int. Cl.

| | |
|---|---|
| ***E02F 3/43*** | (2006.01) |
| ***G09F 19/00*** | (2006.01) |
| ***G06G 7/70*** | (2006.01) |
| ***G05D 1/02*** | (2006.01) |

(52) U.S. Cl.
USPC ..... 414/699; 414/700; 701/50; 37/348

(58) Field of Classification Search
USPC ..... 414/699, 700; 37/348; 701/50
See application file for complete search history.

(56) References Cited

U.S. PATENT DOCUMENTS

| | | | | |
|---|---|---|---|---|
| 5,188,502 | A * | 2/1993 | Tonsor et al. | 414/700 |
| 7,748,147 | B2 | 7/2010 | Schoenmaker et al. | |
| 7,752,778 | B2 | 7/2010 | Schoenmaker et al. | |
| 7,752,779 | B2 | 7/2010 | Schoenmaker et al. | |
| 7,797,860 | B2 | 9/2010 | Schoenmaker et al. | |
| 2005/0058530 | A1 * | 3/2005 | Rokusek et al. | 414/699 |

OTHER PUBLICATIONS

"The Backhoe That Thinks It's an Excavator" from Construction Equipment, May 1, 2005, 3 pages.*

* cited by examiner

*Primary Examiner* — Scott Lowe

(57) ABSTRACT

A backhoe loader 10 with a controller 100 that uses angular signals from at least one sensor to calculate a loader tool angle with respect to the vehicle frame 12 or with respect to the earth and to maintain the loader tool angle via controller generated commands to a tool actuator 61 as a function of the angular signals and commands to a boom actuator 50. The controller 100 enables proportional control of the tool angle via a command input device such as an electronic joystick 21. If the electronic joystick 21 is moved to an appropriate detent position, the controller executes a return to carry function. If the boom 31 is at or below the return to carry angle at the time the joystick 21 is moved to the detent position, the controller 100 executes a float function allowing the bucket 36 and the boom 31 to rest on the ground and follow the contours of the earth as the vehicle moves over the earth.

9 Claims, 12 Drawing Sheets

ELECTRONIC PARALLEL LIFT AND RETURN TO CARRY OR FLOAT ON A BACKHOE LOADER

FIELD OF THE INVENTION

The invention relates to a system for sensing and automatically controlling the orientation of a work tool

BACKGROUND OF THE INVENTION

A variety of work machines can be equipped with tools for performing a work function. Examples of such machines include a wide variety of loaders, excavators, telehandlers, and aerial lifts. A work vehicle such as backhoe loader may be equipped with a backhoe tool, such as a backhoe bucket or other structure, for excavating and material handling functions as well as a loader tool such as a loader bucket.

In the backhoe portion of the backhoe loader, a swing frame pivotally attaches to the vehicle frame at a rear portion of the vehicle, a backhoe boom pivotally attaches to the swing frame, a dipperstick pivotally attaches to the backhoe boom, and the backhoe tool pivotally attaches to the dipperstick about a backhoe tool pivot. A vehicle operator controls the orientation of the backhoe bucket relative to the dipperstick by a backhoe tool actuator. The operator also controls the rotational position of the boom relative to the vehicle frame, and the dipperstick relative to the boom, by corresponding actuators. The aforementioned actuators are typically comprised of one or more double acting hydraulic cylinders and a corresponding hydraulic circuit.

In the loader portion of the backhoe loader the loader boom is pivotally attached to the vehicle frame at a front portion of the backhoe loader and a loader tool, such as a loader bucket, is pivotally attached to the loader boom at a loader bucket pivot. Typically, the bucket is operatively attached to a linkage which is also connected to the vehicle frame or the boom. Work operation with a loader bucket entails similar problems to those encountered in work operations with the backhoe bucket.

During a work operation with a loader tool, such as lifting, lowering or dumping material, it is desirable to maintain an initial orientation relative to the frame of the vehicle to prevent premature dumping of material, or to obtain a constant loader tool angle. In conventional backhoe loaders, the operator is required to continually manipulate a loader tool command input device to adjust the loader tool orientation as the loader boom is moved during the work operation to maintain the initial loader tool orientation relative to the vehicle frame. The continual adjustment of the loader tool orientation, combined with the simultaneous manipulation of a loader boom command input device, requires a degree of operator attention and manual effort that can diminish overall work efficiency and increase operator fatigue.

A number of mechanisms and systems have been used to automatically control the orientation of work tools such as loader buckets. Various examples of electronic sensing and control systems are disclosed in U.S. Pat. Nos. 4,923,326, 4,844,685, 5,356,260, 6,233,511, and 6,609,315. Control systems of the prior art typically utilize position sensors attached at various locations on the work vehicle to sense and control tool orientation relative to the vehicle frame. Additionally, the U.S. Pat. No. 6,609,315 makes use of an angular velocity sensor attached to the tool to sense and maintain a fixed work tool orientation relative to an initial tool orientation, independent of vehicle frame orientation. Also, U.S. Pat. No. 7,222,444, makes use of a tilt sensor that, when attached to an object, such as the tool, detects the object's inclination with respect to the earth.

SUMMARY OF THE INVENTION

An object of the present invention is to provide an improved system for controlling the orientation of a tool for a work vehicle.

The illustrated invention comprises a backhoe loader which includes a backhoe assembly, and a loader assembly. The backhoe assembly includes a swing frame pivotally attached to the frame of the backhoe loader, a backhoe boom attached to the swing frame, a backhoe boom actuator for controllably pivoting the boom relative to the swing frame, a dipperstick pivotally attached to the boom, a dipperstick actuator for controllably pivoting the dipperstick relative to the boom, a backhoe tool pivotally attached to the dipperstick, and a backhoe to actuator for controllably moving the backhoe tool about its pivot.

The loader assembly includes a loader boom pivotally attached to the vehicle frame, a loader boom actuator for controllably pivoting the loader boom relative to the vehicle frame, a loader tool pivotally attached to the loader boom, and a loader tool actuator for controllably pivoting the loader tool relative to the loader boom. The loader also includes a loader tool command device to effect operation of the loader tool actuator and a mode switch to enable and disable features of the invention. The invention addresses the loader portion of the backhoe loader.

In the invention, the vehicle has at least one of a first mode and a second mode, each mode being enabled by a mode switch. In the first mode a controller allows the loader tool to respond to boom manipulation in a conventional manner, i.e., the angle of the loader tool is adjusted on a strictly mechanical basis in accordance with the mechanical interplay between the boom, a loader tool linkage and the loader tool. In the second mode, which is a parallel lift mode a controller causes the angle of the tool to be adjusted in accordance with an electronic program throughout an angular movement of the boom regardless of any particular mechanical relationship between the tool linkage, the boom and the loader tool. In the second mode, the invention uses at least one sensor to detect an angle of a loader tool with respect to a datum such as, for example, the vehicle frame and maintain that angle throughout a boom rotation with respect to the datum unless parallel lift is deactivated during boom travel or the boom reaches an angle in which another function takes precedence. The controller maintains the tool orientation by commanding the tool actuator to adjust the tool position as a function of the boom angle with respect to the vehicle frame. The initial tool angle is set and stored at the time parallel lift is activated and updated each time the tool angle is changed via the manipulation of a tool command input device such as, for example, a joystick as long as parallel lift is enabled. When parallel lift is deactivated, i.e., disabled, the vehicle returns to the first mode and no new angles are set or updated until parallel lift is re-enabled.

The invention provides for other functions for controlling the loader tool such as, for example, return to carry, return to dig and anti-spill which is designed to keep a loader bucket from spilling its contents on the hood or cab of the vehicle.

DESCRIPTION OF THE PREFERRED EMBODIMENT

Figure 1:
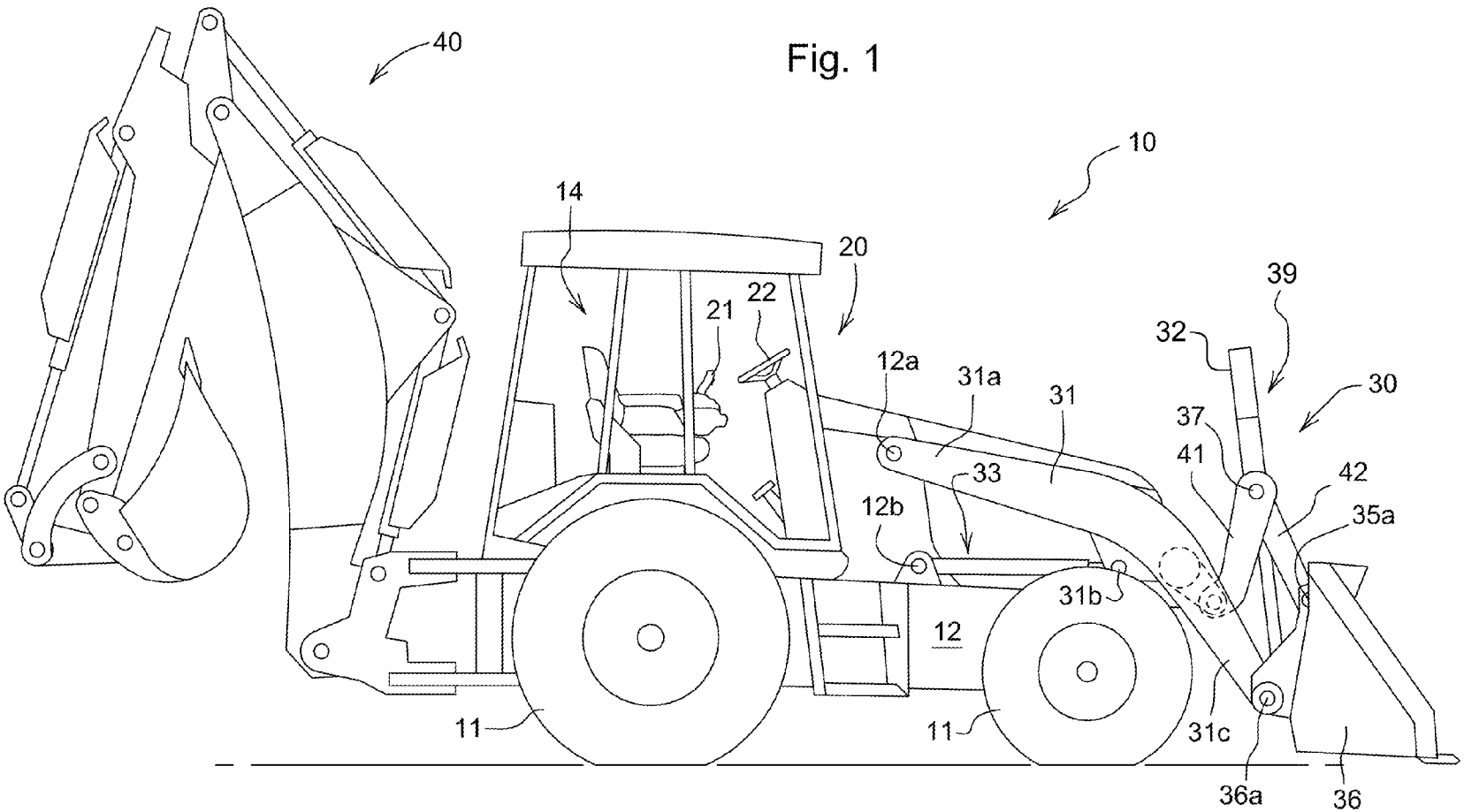
FIG. 1 is a side view of a backhoe loader.

FIG. 1 illustrates an exemplary work vehicle, i.e., a backhoe loader 10 in which the invention may be utilized. The backhoe loader 10 has a frame 12, to which are attached ground engaging wheels 11 for supporting and propelling the vehicle 10. Attached to the front of the vehicle is a loader assembly 30, and attached to the rear of the vehicle 10 is a backhoe assembly 40. Both the loader assembly 30 and backhoe assembly 40 perform a variety of material handling functions. An operator controls the functions of the vehicle 10 from an operator's station 20.

This particular loader assembly 30 comprises a loader boom 31, a linkage 39 and a tool such as, for example, a loader bucket 36. The loader boom 31 has a first end 31*a* pivotally attached to the frame 12 at a horizontal loader boom pivot 12*a*, and a second end 31*c* to which the loader bucket 36 pivotally attaches at a loader bucket pivot 36*a*.

Figure 2:
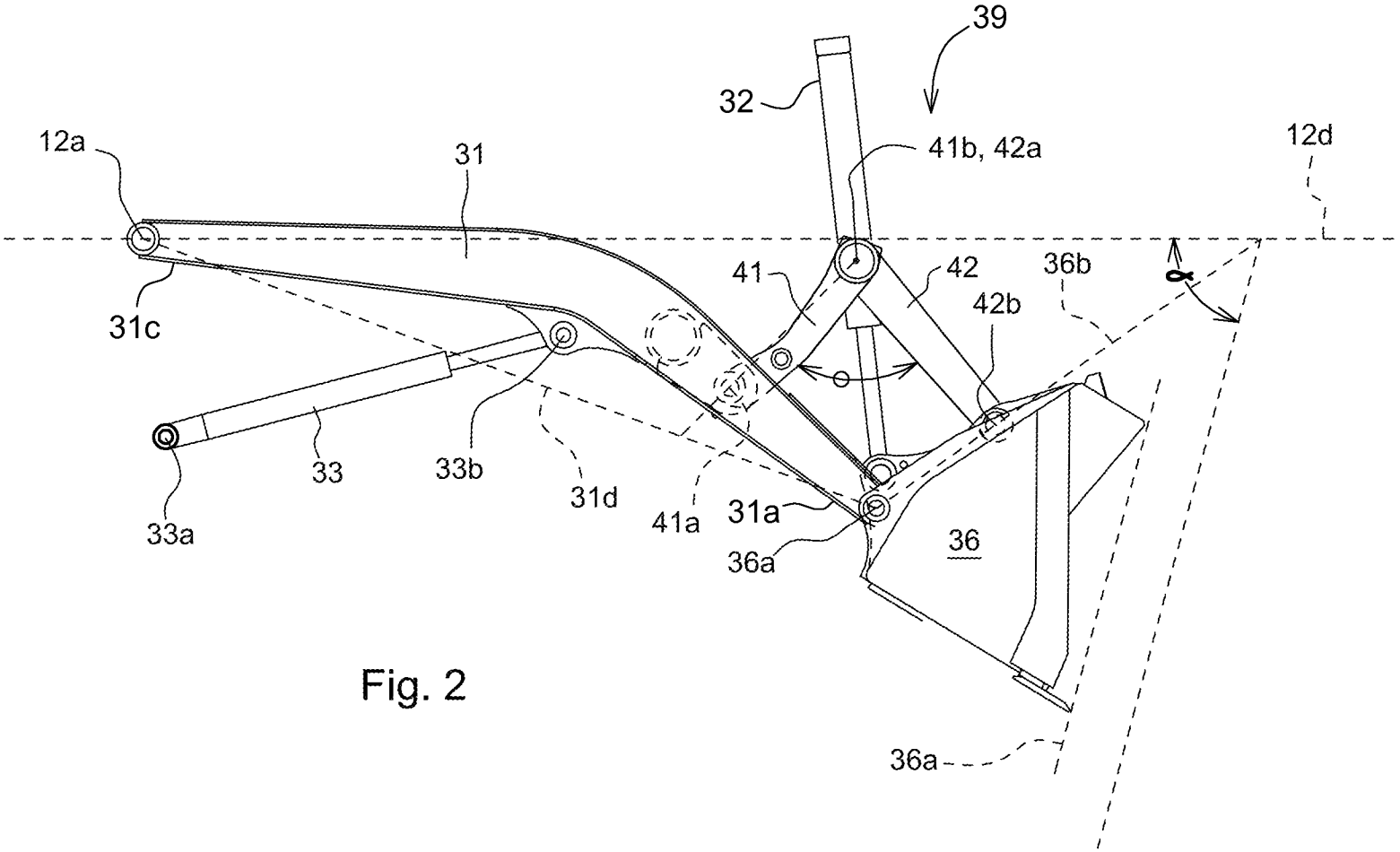
FIG. 2 is a detailed view of a loader portion of the backhoe loader.

The linkage 39, illustrated in FIG. 2, includes a boom link 41 and a bucket link 42. The boom link 41 is pivotally attached to the boom 31 at a first boom link pivot 41*a* and pivotally attached to a loader bucket hydraulic cylinder 32 at a second boom link pivot 41*b*. The bucket link 42 is pivotally attached to the loader bucket hydraulic cylinder 32 at a first bucket link pivot 42*a* and pivotally attached to the bucket 36 at a second bucket link pivot 42*b*. In this particular case, the second boom link pivot 41*b* and the first bucket link pivot 42*a* are the same, i.e., they are both pivot 37 (FIG. 1). As the loader bucket hydraulic cylinder extends and retracts, an angle θ between the boom link 41 and the bucket link 42 decreases and increases respectively.

Figure 3:
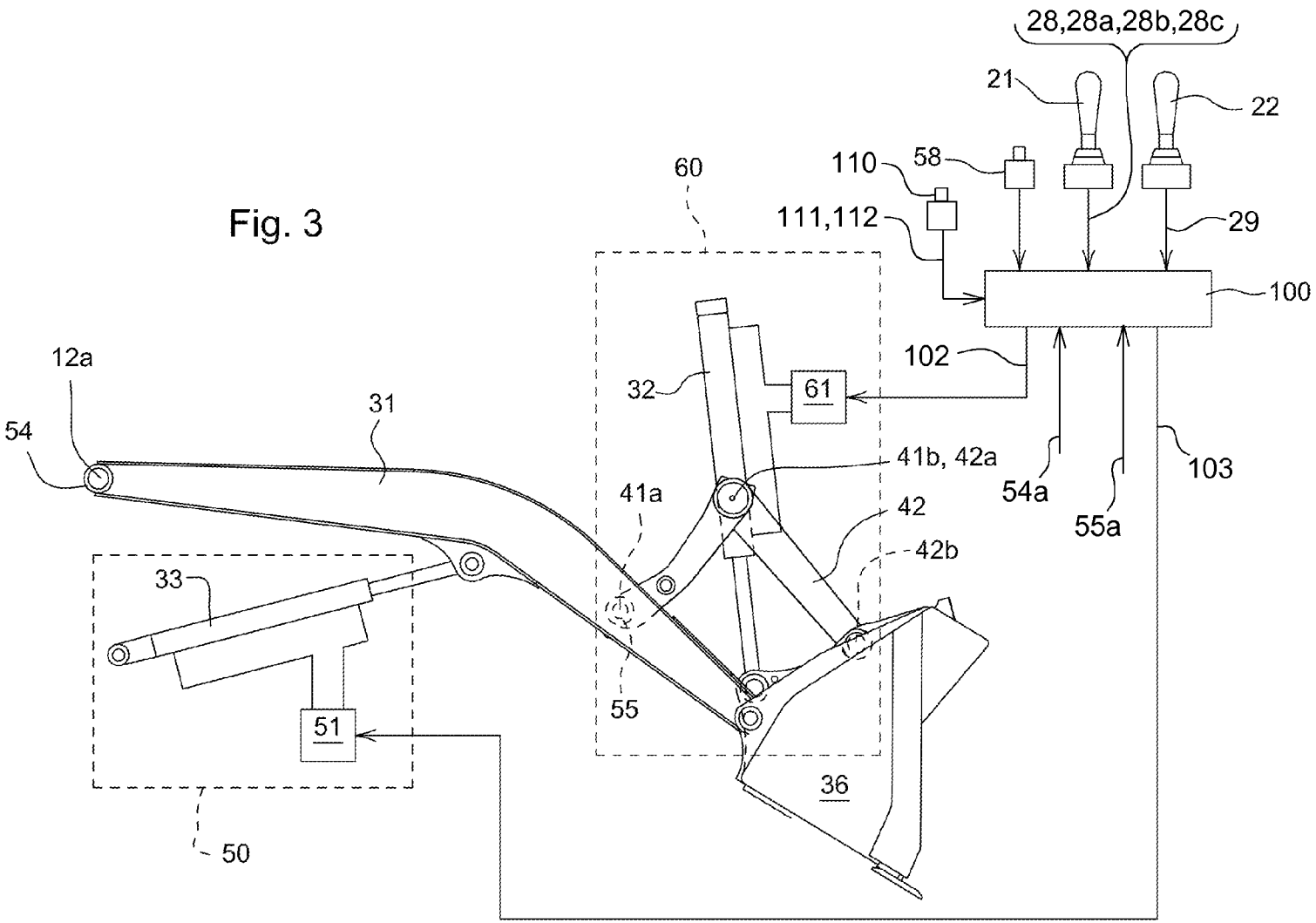
FIG. 3 is a schematic diagram illustrating an exemplary embodiment of the components of the invention with respect to a control system for the loader tool.

FIG. 3 illustrates a schematic representing an exemplary embodiment of the invention. In FIG. 3, a loader boom actuator 50, having a loader boom hydraulic cylinder 33 extending between the vehicle frame 12 and the loader boom 31, controllably moves the loader boom 31 about the loader boom pivot 12*a*. The loader boom hydraulic cylinder 33 is pivotally attached to the frame 12 at a first loader boom hydraulic cylinder pivot 33*a* and pivotally attached to the loader boom 31 at a second loader boom hydraulic cylinder pivot 33*b*. In the illustrated embodiment, the loader boom actuator 50 comprises a boom electro-hydraulic circuit 51 hydraulically coupled to the loader boom hydraulic cylinder 33. A controller 100 supplies and controls the flow of hydraulic fluid to and from the loader boom hydraulic cylinder 33 via the loader boom electro-hydraulic circuit 51. The controller 100 may take many forms from a hard wired or mechanical device to a programmable computer. In this embodiment of the invention, the controller 100 comprises a programmable on-board electronic computer.

A loader bucket actuator 60, having a loader bucket hydraulic cylinder 32 extending between the loader boom 31 and the loader bucket 36, controllably moves the loader bucket 36 about the loader bucket pivot 36*a*. In the illustrated embodiment, the loader bucket actuator 60 comprises a bucket electro-hydraulic circuit 61 hydraulically coupled to the loader bucket hydraulic cylinder 32. The controller 100 controls the bucket electro-hydraulic circuit 61 which supplies and controls the flow of hydraulic fluid to the loader bucket hydraulic cylinder 32. Note that the boom electro-hydraulic circuit 51 and the bucket hydraulic circuit 61 are conventionally configured and may have significant commonality; they may, in fact, be the same circuit.

The operator commands movement of the loader assembly 30 by manipulating a loader bucket command input device such as, for example a joystick 21 and a loader boom command input device such as, for example a joystick 22. The joystick 21 is adapted to generate a loader bucket command signal 28 in proportion to a degree of manipulation by the operator and proportional to a flow rate of fluid to the bucket hydraulic cylinder 32 which is directly proportional to an angular speed of a desired loader bucket movement. The controller 100, in communication with the loader bucket command input device, i.e., joystick 21 and loader bucket actuator 60, receives the loader bucket command signal 28 and responds by generating a controller bucket command signal 102 proportional to the bucket command signal 28, which is received by the loader bucket electro-hydraulic circuit 61. The loader bucket electro-hydraulic circuit responds to the controller bucket command signal 102 by directing hydraulic fluid of and from the loader bucket hydraulic cylinder 32, causing the hydraulic cylinder to extend and retract and curl and dump the loader bucket 36 accordingly.

The joystick 22 is adapted to generate a loader boom command signal 29 in proportion to a degree of manipulation in a first direction of the joystick 22 by the operator, the boom command signal 29 being proportional to a flow rate of fluid to the hydraulic boom cylinder 33 and directly proportional to a speed of a desired loader boom movement. The controller 100, in communication with the joystick 22 and loader boom actuator 50, receives the loader boom command signal 29 and responds by generating a controller boom command signal 103 proportional to the loader boom command signal 29, which is received by the boom electro-hydraulic circuit 51. The boom electro-hydraulic circuit 51 responds to the controller boom command signal 103 by directing hydraulic fluid to and from the loader boom hydraulic cylinder 33 at a rate proportional to the controller boom command signal 103, causing the hydraulic cylinder 33 to move the loader boom 31 about the pivot 12*a* accordingly.

The joystick 21 is adapted to generate a loader boom command signal 29 in proportion to a degree of manipulation in a first direction of the joystick 21 by the operator, the boom command signal 29 being proportional to a flow rate of fluid to the hydraulic boom cylinder 33 and indirectly proportional to a speed of a desired loader boom movement. The controller 100, in communication with the joystick 21 and loader boom cylinder 33, receives the loader boom command signal 29 and responds by generating a controller boom command signal 103 proportional to the loader boom command signal 29, which is received by the boom electro-hydraulic circuit 51. The boom electro-hydraulic circuit 51 responds to the controller boom command signal 103 by directing hydraulic fluid to and from the loader boom hydraulic cylinder 33 at a rate proportional to the controller boom command signal 103, causing the hydraulic cylinder 33 to move the loader boom 31 about the pivot 12*a* accordingly.

Parallel Lift and Initial Angular Setting of the Loader Tool

During a work operation with the loader bucket 36, such as lifting, lowering or transporting material, it is, at times, desirable to maintain an initial loader bucket orientation relative to the vehicle to reduce premature dumping of material as well as increase general operator convenience. In a conventional backhoe, to maintain the initial loader bucket orientation, with respect to the frame 12, as the loader boom 31 is lifted or lowered relative to the frame 12, the operator is required to continually manipulate the loader bucket command input device, i.e., joystick 21 to adjust the loader bucket orientation. The continual adjustment of the orientation of the loader bucket 36 requires a degree of attention and manual effort from the operator that diminishes overall work efficiency and increases operator fatigue.

The exemplary control system of the invention, illustrated in FIG. 3, is adapted to automatically maintain an initial or a set loader bucket orientation or tilt angle with respect to a datum, such as, for example, horizontal datum plane 12*d* (FIG. 2) representing the vehicle frame 12, as an angle of the boom 31 changes. This embodiment of the invention makes use of at least a loader boom angle sensor 54 proximal to the first boom pivot 12*a*, intersected by the datum plane 12*d*, and a boom link angle sensor 55 proximal to the first boom link pivot 41*a*, both angle sensors 54, 55 being in communication with the controller 100. The loader boom angle sensor 54 is adapted to sense an angle of the boom relative to the frame 12, i.e., a boom to frame angle BmA and to generate a corresponding loader boom angle signal 54*a*. The boom link angle sensor 55 is adapted to sense an angle of the boom link 41 relative to the loader boom 31 and to generate a corresponding boom link angle signal 55*a*. The controller 100 is adapted to receive the loader boom command signal 29, the loader boom angle signal 54*a*, the bucket command signal 28, and the boom link angle signal 55*a* and to generate a controller bucket command signal 102 in response, causing the loader bucket actuator 60 to move the loader bucket 36 to maintain a desired loader bucket angle with respect to the frame 12 and, consequently, with respect to the boom 31.

Where the object of the invention is a parallel lift function to maintain an initial loader bucket angle, relative to the frame 12, the desired loader bucket angle is maintained unless maintenance of this angle interferes with other automatic functions such as, for example, return to dig, return to carry and anti-spill (to be described later) of higher precedence. Additionally, the controller 100 is adapted to allow a manual override of engaged parallel lift when the operator commands movement of the loader bucket 36, via a manipulation of the joystick 21 in a second direction, i.e., upon the controller 100 receiving the loader bucket command signal 28 while the parallel lift function is engaged, and establishing a new initial loader bucket orientation at the sensed orientation of the loader bucket 36 after the loader bucket command signal 28 terminates.

In the illustrated embodiment, the present invention also utilizes a parallel lift command switch 110 in communication with the controller 100. The parallel lift command switch 110 is adapted to generate a parallel lift enable signal 111 corresponding to a first manipulation of the parallel lift command switch 110 by the operator to enable operation of the parallel lift function for the loader bucket 36 and to generate a parallel lift disable signal 112 corresponding to a second manipulation of the parallel lift command switch 110. With respect to the parallel lift function, the controller 100 is adapted to ignore the loader boom link angle signal 55*a* until the controller 100 receives the parallel lift enable signal 111 from the parallel lift command switch 110. The parallel lift enable signal 111 places the controller 100 in a first mode where parallel lift is enabled or activated. The parallel lift disable signal 112 places the controller 100 in a second mode where parallel lift is disabled or deactivated. The controller 100 is also adapted to generate controller bucket command signals 102 and controller boom command signals 103 to manipulate the bucket 36 and the boom 31 in response to return to carry commands, returned to dig commands, and anti-spill commands which will be explained in some of the remaining portions of this document.

In operation, upon receiving a parallel lift enable signal 111, the controller 100 enters the first mode and uses a loader boom angle signal 54*a* and a boom link angle signal 55*a* to determine an initial angle of the bucket 36 with respect to the frame 12, i.e., the bucket to frame angle. Of course, any calculation of the bucket angle must account for the geometry of the bucket. Thus, in this embodiment, the angle of the bucket 36 with respect to the frame 12 is calculated as $\alpha$=BmA+BtA, where a equals the bucket to frame angle, BmA equals the boom to frame angle and BtA equals the angle of the bucket 36 with respect to the boom 31, i.e., the bucket to boom angle. The controller calculates the BtA by using the boom link angle signal 55*a* to determine the angle of a back of the bucket 36 and subtracting OA, an offset angle, from the result, the offset angle being a corrective angle introduced to take the shape of the bucket 36 into account when determining an angle of an open face of the bucket 36. In this particular case the shape of the bucket 36 affords a difference between an angle of a face of the bucket 36 as represented by plane 36*a* and a back portion of the bucket pivotally connected to the boom 31 and the bucket link 42*b* as represented by plane 36*b*. Thus, $\alpha$ is the angle of the face of the bucket, i.e., the angle of plane 36*a*, with respect to the datum plane 12*d*, a going to 0° as the angular orientation of plane 36*a* approaches that of the datum plane 12*d*. In summary, the controller 100 uses the boom link angle signal 55*a* to determine the angle of plane 36*b* with respect to the boom 31, i.e., boom plane 31*d* and the offset value is subtracted from that result to determine the angle of the BtA. The controller 100 uses the boom angle signal 54*a* to determine the BmA. Once the controller 100 determines the BmA and BtA the controller 100 can determine a by adding BmA and BtA. These and other determinations and/or calculations, throughout this embodiment, may be accomplished via a variety of conventional methods including: lookup tables, numerically derived equations, analytically derived equations taking the lengths of the boom link 41 and the bucket link 42 into account, etc.

Figure 4A:
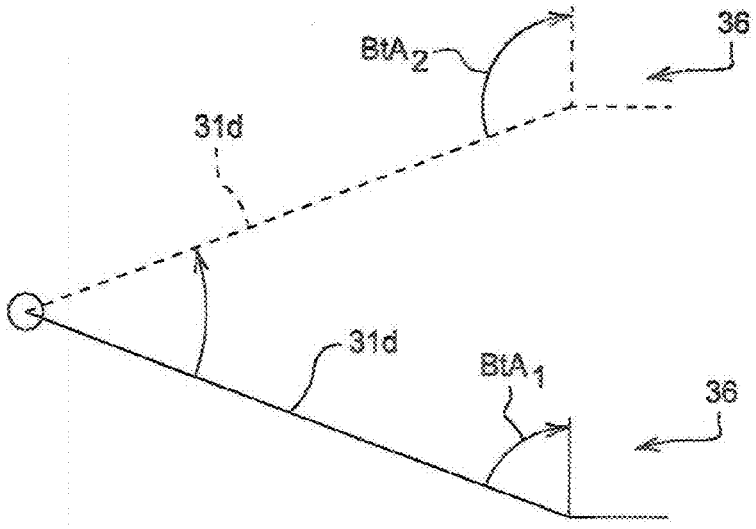
FIG. 4*a* illustrates how the angle of the loader tool changes as the boom rotates in an upward direction.
Figure 4B:
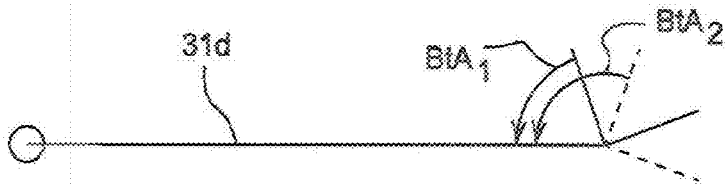
FIG. 4*b* illustrates more graphically how the angle of the loader tool with respect to the boom changes in FIG. 4*a;*
Figure 5A:
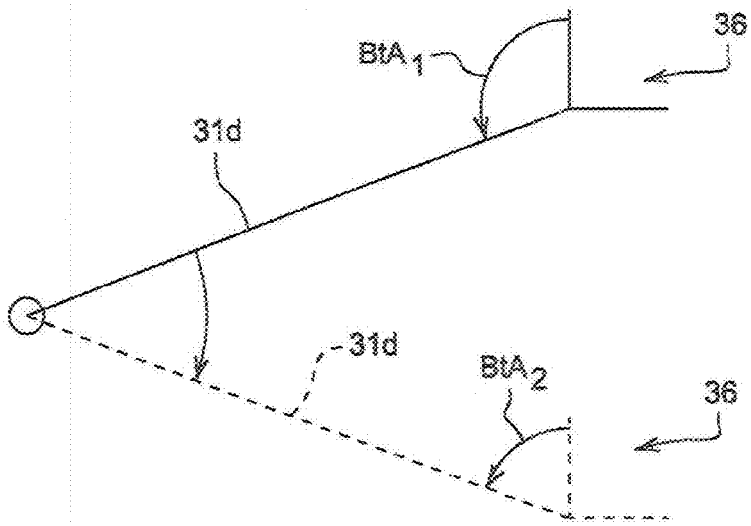
FIG. 5*a* illustrates how the angle of the loader tool changes as the boom rotates in an downward direction.
Figure 5B:
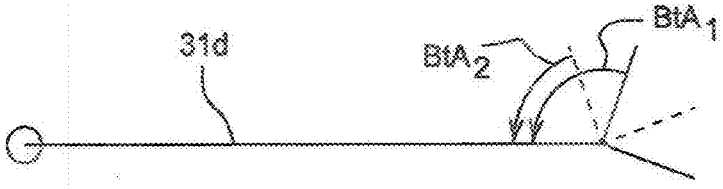
FIG. 5*b* is a schematic diagram illustrating how the angle of the loader tool changes as the boom rotates in an downward direction.

As the boom rises, $\alpha$ is maintained by adjusting the BtA in a motion resembling dumping, as illustrated in FIGS. 4A and 4B, as the BtA changes from $BtA_1$ to $BtA_2$. Thus, such adjustments shall be called "dumping" adjustments. As the boom lowers, α is maintained by adjusting BtA in a motion resembling curling, as illustrated in FIGS. 5A and 5B, as the BtA changes from $BtA_2$ to $BtA_1$. Thus, such adjustments shall be called "curling" adjustments.

Hybrid Control of Adjustments

As the boom 31 rises or lowers, the controller makes BtA adjustments by generating controller bucket command signals 102, i.e., bucket commands, to extend or retract the loader bucket hydraulic cylinder 32 as required by predictive and corrective control procedures. The predictive control procedures allow for quicker response times for the loader bucket 36. The corrective control procedures increase the accuracy of the response in approximating parallel lift.

In the predictive control procedures, the controller 100 calculates the BtA adjustments using only the loader boom command signal 29, the loader boom angle signal 54*a* and the geometries of the linkage 30, the bucket 36 and the boom 31. This allows for quick bucket adjustments, via bucket command signals 28, when the boom rises or lowers as the calculations merely depend upon geometry and the predicted rate of change in the BmA using the controller boom command signals 103 to predict the rate of change of the BmA, the flow rate to the loader boom hydraulic cylinder being proportional to the controller boom command signals 103. Of course, the controller 100 could, in other embodiments, also predict the rate of change in the BmA by determining the measured rate of change using the loader boom angle signals 54*a* over time. However, whichever method is used, the predictive procedure is an open loop procedure that could possibly introduce cumulative error as the calculations do not take actual BtA, i.e., feedback, into consideration.

The corrective procedure is a closed loop procedure in which possible error is reduced when the controller 100 uses the boom link angle signal 55*a* to calculate an actual angle of the bucket 36 and act upon a difference between a predicted BtA and the actual BtA when the difference is equal to or greater than a threshold value such as, for example, 0° or 30°. The correction is made by adjusting the controller bucket command signal 102, taking the controller boom command signal 103, the boom angle signal 54*a* and the boom link angle signal 55*a* into account, in an effort to reduce the difference to zero. In this embodiment, if the BtA is undercorrected beyond effective adjustment at the current flow rate for the boom 31, the controller 100 reduces the controller boom command signals 103 to zero until BtA changes such that α is correctly adjusted. Conversely, if the BtA is overcorrected, the controller reduces the controller bucket command signals 102 to zero until, taking BmA command into account, the BmA changes such that the BtA is correctly adjusted. Other embodiments could allow the controller 100 to correct the BtA in the opposite angular direction in the event of overcorrection.

Manual Override of Parallel Lift Via Joystick Manipulation

Figure 6:
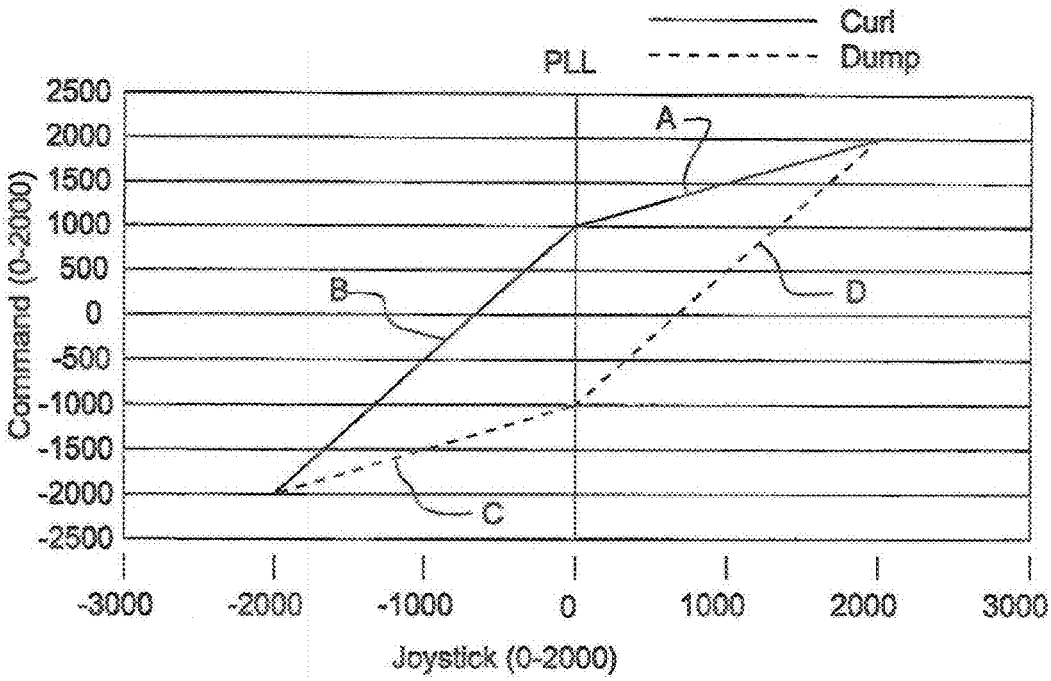
FIG. 6 graphically illustrates how the loader tool responds to one example joystick override command while parallel lift is enabled.

If the loader bucket 36 is manually commanded, via the joystick 21, to dump or curl while the parallel lift function is engaged, the parallel lift function continues to adjust the angle of the loader bucket 36 in a manner approximating parallel lift. However, as indicated in FIG. 6, the BtA is further adjusted in the direction of and in proportion to the manual command using the BtA due to parallel lift as a new zero point for BtA change rate. Naturally, the maximum rate of change for BtA is the same as the maximum rate of change for BtA with parallel lift disabled. In FIG. 6, the absolute value of 2000 represents a maximum command rate for the bucket and the absolute value of 1000 represents the parallel lift command rate. In this particular case, the controller 100 sets the values of 1000 and −1000 for parallel lift curl and parallel lift dump, respectively. As can be readily observed in FIG. 6, the controller 100 will, for this function, generate controller bucket command signals 102 proportional to the degree of manipulation of the joystick 21 between the absolute values of 1000 and the absolute values of 2000, using the absolute value of 1000 as the zero point, i.e., the target for controller bucket command signal 102 with no manipulation of the bucket command input device, i.e., joystick 21 and the absolute value of 2000 as the maximum, i.e., the target for the controller bucket command signal 102 with the maximum degree of manipulation of the joystick 21. Of course the absolute value of 1000 is referenced here merely for illustrative purposes. In reality the value used as a point of reference is dynamic, and changes as the boom command signal 29 changes or as the actual rate of change in the BmA changes.

This arrangement allows for greater control of the bucket 36 as the change in rate of the BtA with respect to the parallel lift function is proportional to the degree of manipulation of the bucket command input device, i.e., joystick 21.

Return to Carry, Return to Dig and Boom Height Kickout

During the operation of the loader portion 30 of a backhoe loader 10 it is oftentimes convenient for the operator to establish automatic functions such as, for example, return to carry (RTC), return to dig (RTD, and boom height kickout (BHK). The invention provides for these functions.

Return to Carry

Figure 7:
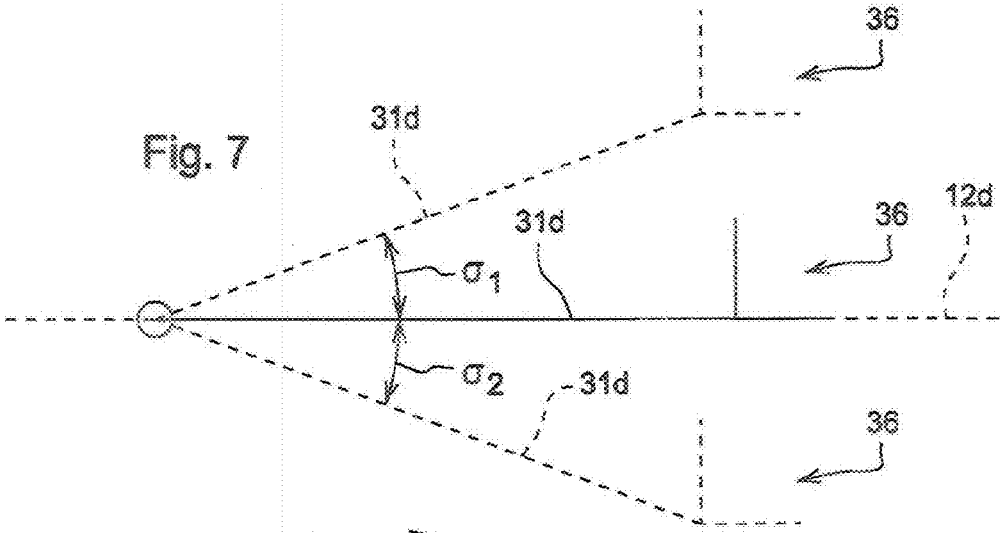
FIG. 7 illustrates how the angle of the loader to changes as the boom moves toward σ1 and toward σ2 while parallel lift is enabled.

Return to carry, i.e., RTC is a function that enables an operator to command the vehicle 10 to automatically locate the boom 31 at a first predetermined BmA such as, for example, σ1 in FIG. 7. The first predetermined BmA is set when the operator commands the boom 31 to move to σ1 and, by means of a button 58, records σ1 in the system, i.e., the controller 100, as a predetermined BmA for RTC.

Figure 8:
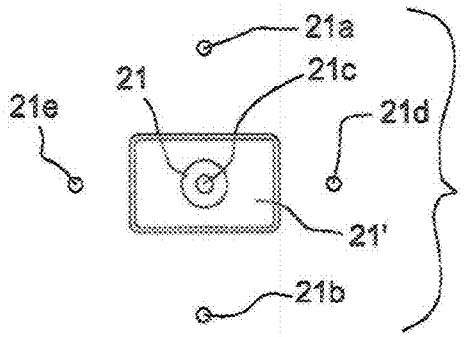
FIG. 8 is a schematic top view showing a neutral position and various detent positions of one of the joysticks.

To execute RTC, the operator pushes the electronic joystick 21 to a first detent position 21*a*, illustrated in FIG. 8, in which a detent is felt which is, generally, at the end of travel for the joystick 21. The joystick 21 then generates a first detent command signal 28*a*. The controller 100 receives the first detent command signal 28*a* then, if the BmA is greater than σ1, the controller 100 generates controller boom command signals 103 to move the boom 31 in the direction of σ1. If the joystick 21 is released to return to the neutral position 21*c*, to which it is biased, prior to the boom achieving an angle of σ1 the controller 100 will continue to generate controller boom command signals 103 to move the boom 31 toward σ1 until the boom 31 achieves the angle σ1. When the boom angle signal 54*a* indicates that the boom has achieved σ1, the controller 100 stops generating the controller boom command signals 103 resulting from the first detent command signal 28*a*.

Figure 9:
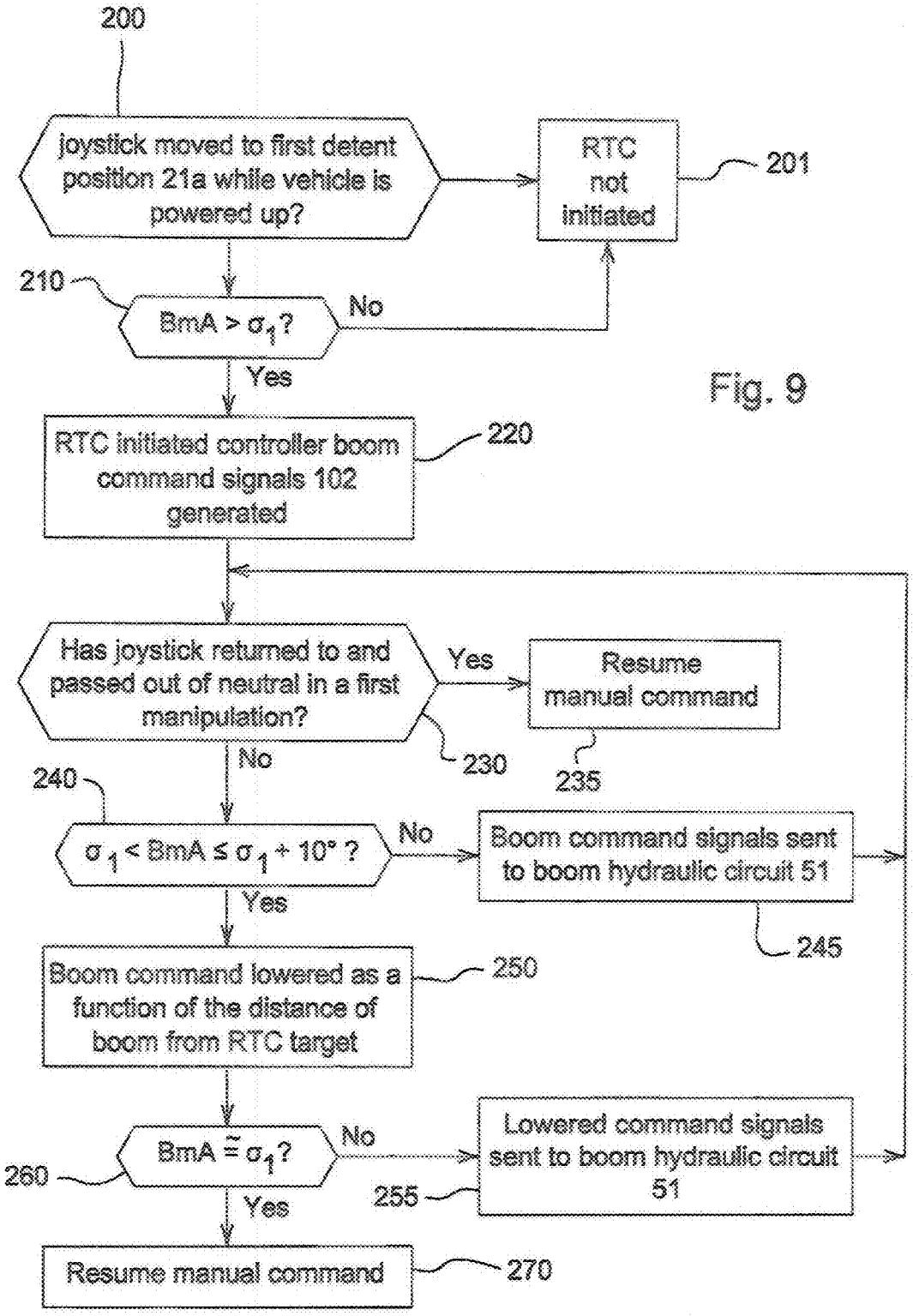
FIG. 9 illustrates a flow chart outlining the initiation and operation of return to carry.

FIG. 9 illustrates the initiation and operation of RTC in a more detailed and visual manner. As illustrated in FIG. 9, the RTC function can begin only when the operator pushes the electronic joystick 21 to the first detent position 21*a* at step 200, at which point it generates the first detent command signal 28*a*. The controller 100 compares BmA to σ1 at step 210 and initiates RTC at step 220 if BmA is greater than σ1. The controller 100 then initiates a return to carry command mode and generates controller boom command signals 103 at step 220 to move the boom 31 in the direction of σ1. The controller 100 then checks to see whether the joystick 21 has returned to and moved out of the neutral position 21*c* in the direction of 21*a* or 21*b* at step 230. If the answer is yes, the controller 100 resumes manual control. If the answer is no, the controller 100 then checks to see if the relationship σ1<BmA≦σ1+10° is true at step 240. In this embodiment the 10° in the relationship is a cushion start angle. The cushion start angle could be set at any value. If the equation is not true then the controller boom command signals 103 are sent to the boom electrohydraulic circuit 51 at step 245. If the equation is true, then, at step 250, the controller boom command signals 103 are lowered as a function of X, where X is the distance of the boom 31 from the target at σ1. In this particular embodiment, the boom command equals $X^{0.75}[X_{0.75}]$+Offset, where Offset represents a minimum command at the end of any automatic function of the loader assembly 30. The controller 100 then checks to see if the equation, BmA≈σ1, is true at step 260. If the equation is not true, then the controller 100 sends the lowered command signal to the boom electrohydraulic circuit 51 at step 255. If the equation is true, the controller 100 resumes the manual command mode at step 270.

Boom Height Kickout

Boom height kickout is a function that enables an operator to command the vehicle 10 to automatically locate the boom 31 at a second predetermined BmA such as, for example, σ2 in FIG. 7. The second predetermined BmA is set when the operator commands the boom 31 to move to σ2 and, by means of a button 58, records σ2 in the system, i.e., in the controller 100, as a predetermined BmA for boom height kickout.

To execute boom height kickout, the operator pulls the electronic joystick 21, illustrated in FIG. 8, to a second detent position 21*b* in which a detent is felt which is, generally, at the end of travel for the joystick 21. The joystick 21 then generates a second detent command signal 28*b*. The controller 100 receives the second detent command signal 28*b* then, if the BmA is less than σ2, the controller 100 generates controller boom command signals 103 to move the boom 31 in the direction of σ2. If the joystick 21 is released to return to the neutral position 21*c*, to which it is biased, prior to the boom achieving an angle of σ2, the controller 100 will continue to generate controller boom command signals 103 to move the boom 31 toward σ2 until the boom 31 achieves the angle σ2. When the boom angle signal 54*a* indicates that the boom has achieved the angle σ2, the controller 100 stops generating the controller boom command signals 103 resulting from the second detent command signal 28*b*.

Figure 10:
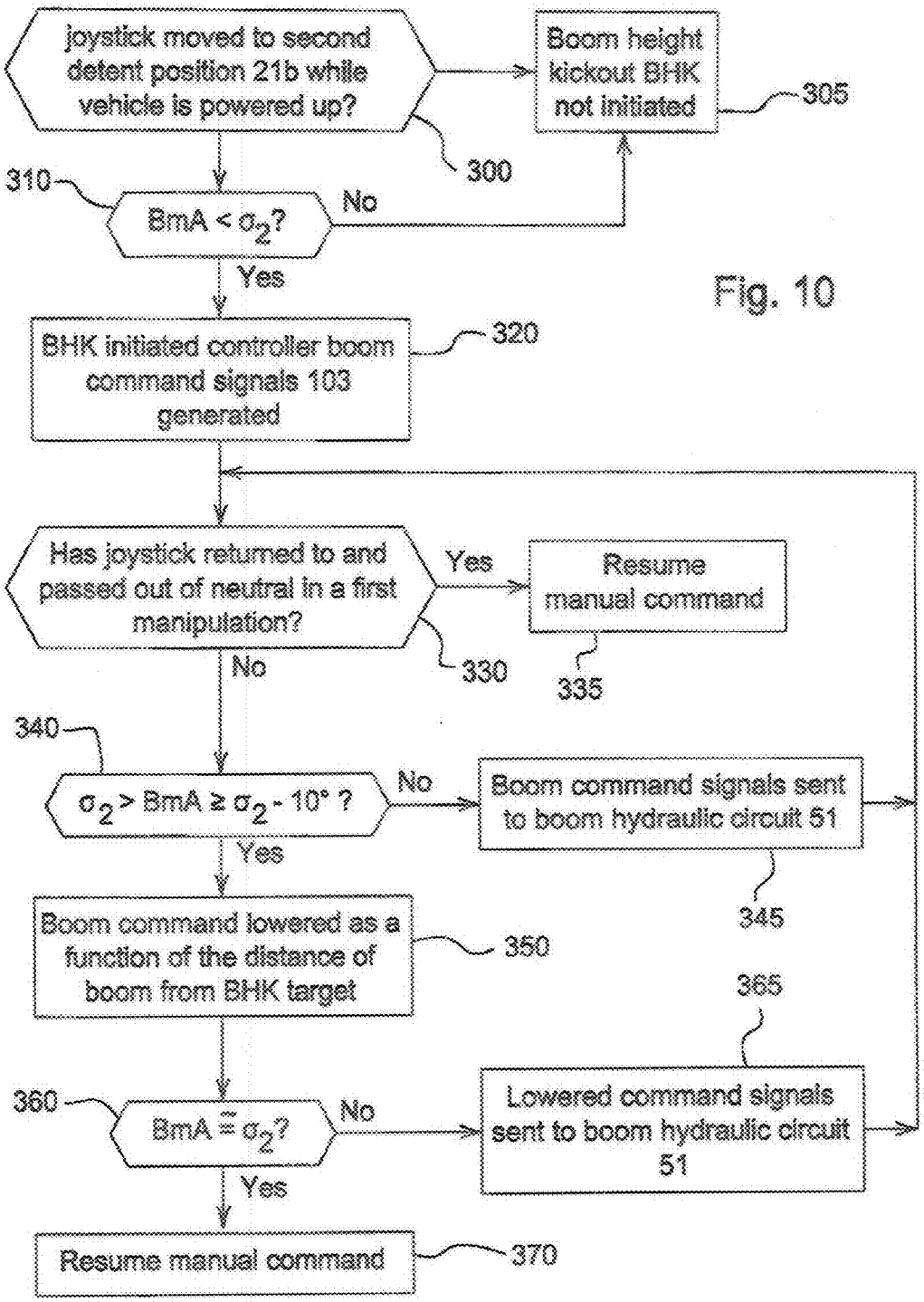
FIG. 10 illustrates a flow chart outlining the initiation and operation of boom height kickout.

FIG. 10 illustrates the initiation and operation of the boom height kickout function in a more detailed and visual manner. As illustrated in FIG. 10, the boom height kickout function can begin only when the operator pulls the electronic joystick 21 to the second detent position 21*b* at step 300, at which point it generates the second detent command signal 28*b*. The controller 100 compares BmA to σ2 at step 310 and initiates boom height kickout at step 320 if BmA is less than σ2. The controller 100 then initiates a boom height kickout command mode and in which it generates controller boom command signals 103 at step 320 to move the boom 31 in the direction of σ2. The controller 100 then checks to see if the joystick 21 has returned to the neutral position 21*c* and moved out of the neutral position in the direction of the detent positions 21*a* or 21*b* at step 330. If the answer is yes, the controller 100 resumes the manual command mode at step 335. If the answer is no, the controller 100 then checks to see if the relationship σ2>BmA≧σ2−10° is true at step 340. If the relationship is not true then the controller boom command signals 103 are sent to the boom electrohydraulic circuit 51 at step 345 and the process starts again at step 330. If the equation is true, then, at step 350, the controller boom command signals 103 are lowered as a function of X, where X is the distance of the boom 31 from the target at σ2 at step 350. In this particular embodiment, the boom command equals $X^{0.75}$−Offset, where Offset represents a minimum command at the end of any automatic function of the loader assembly 30. The controller 100 then checks to see if the equation, BmA≈σ2, is true at step 360. If the equation is not true, then the controller 100 sends the lowered command signal to the boom electrohydraulic circuit 51 at step 365 and starts the process over at step 330. If the equation is true, the controller 100 resumes the manual command mode at step 370.

In this embodiment the 10° in the above relationship is a cushion start angle. The cushion start angle could be set at any value.

If the joystick is moved to the first detent position when the boom is at or below the return to carry position, the controller 100 executes a float function where the cylinders 32, 33 are free to extend and retract under the influence of gravity allowing the boom to fall to the lowest point allowed by the ground and for the boom and bucket to follow the contours of the ground as the vehicle moves over the ground. The controller 100 may execute the float function by conventional means.

Return to Dig

Return to dig is a function that enables an operator to command the vehicle 10 to automatically locate the bucket 36 at a return to dig BtA, β1, and a return to dig angle $\alpha_{rtd}$ suitable for digging. β1 and $\alpha_{rtd}$ are set when the operator commands the bucket 36 to move to β1 and, by means of a button 58, records β1 in the system, i.e., the controller 100, as a predetermined return to dig BtA and a predetermined bucket to frame angle $\alpha_{rtd}$ for return to dig. Return to dig is, generally, used to place the bucket 36 in an angular position favored for digging or scooping up material. When the controller 100 executes return to dig it suspends parallel lift if it is active. When the bucket 36 reaches the return to dig BtA, parallel lift is resumed if the controller 100 detects that it is still active and maintains $\alpha_{rtd}$. In this manner, the controller 100 will maintain the bucket orientation at $\alpha_{rtd}$ until the parallel lift function is completed.

To execute return to dig, the operator moves the electronic joystick 21, illustrated in FIG. 8, to a third detent position 21*d* in which a detent is felt which is, generally, at the end of travel for the joystick 21. The joystick 21 then generates a third detent command signal 28*c*. The controller 100 receives the third detent command signal 28*c* then, if the BtA is greater than β1, the controller 100 generates controller bucket command signals 102 to move the bucket 36 in the direction of β1 via dumping. If BtA is less than β1, the controller generates controller bucket command signals to move the bucket 36 in the direction of β1 via curling. If the joystick 21 is released to return to the neutral position 21*c*, to which it is biased, prior to the bucket 36 achieving an angle of β1 the controller 100 will continue to generate controller bucket command signals 102 to move the bucket 36 toward β1 until the bucket 36 achieves the angle β1. When the boom link angle signal 55*a* indicates that the bucket has achieved β1, the controller 100 stops generating the controller bucket command signals 102 resulting from the third detent command signal 28*c*.

Figure 11:
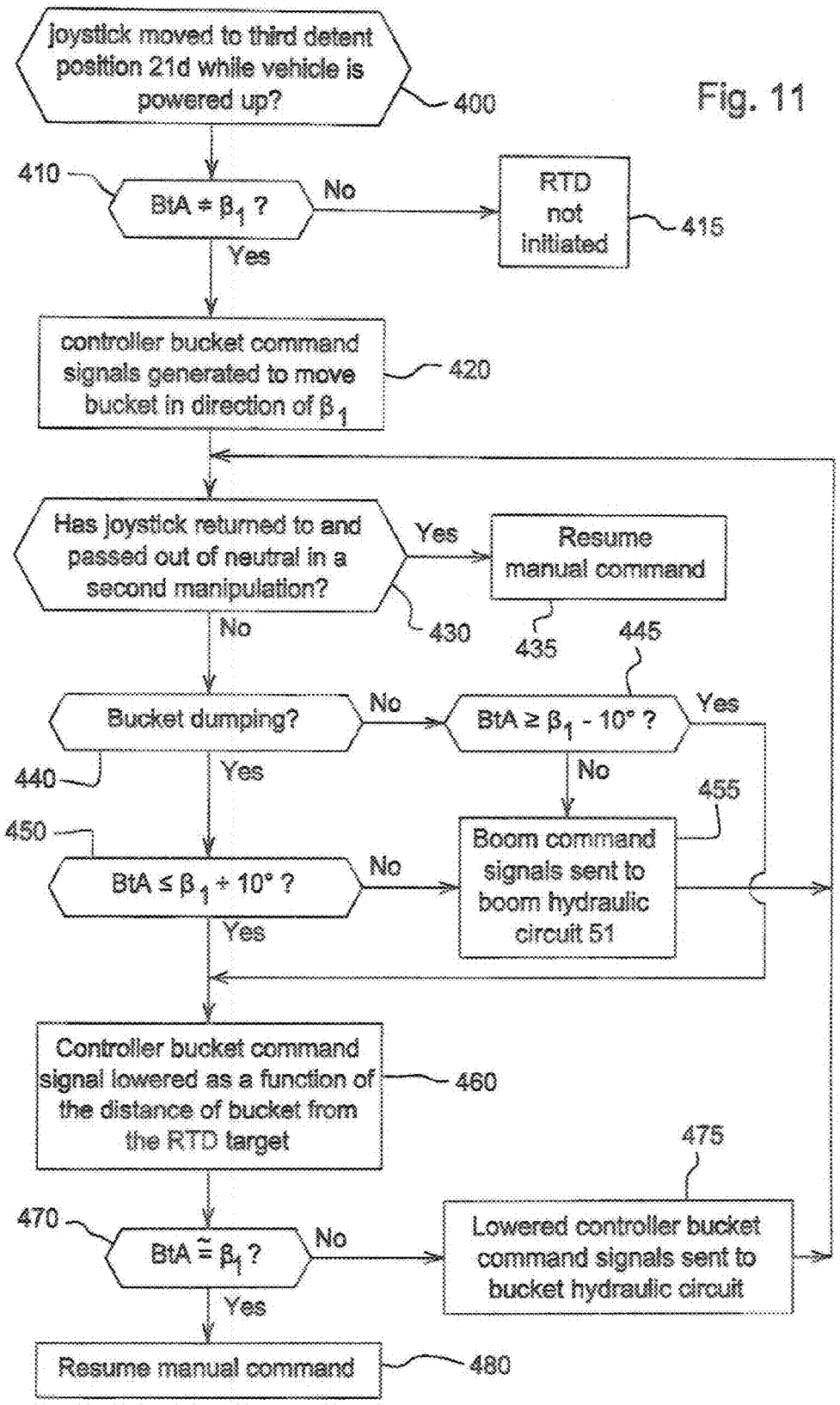
FIG. 11 illustrates a flow chart outlining the initiation and operation of return to dig.

FIG. 11 illustrates the initiation and operation of the return to dig function in a more detailed and visual manner. As illustrated in FIG. 11, the return to dig function can begin only when the operator moves the electronic joystick 21 to the third detent position 21*d* at step 400, at which point it generates the third detent command signal 28*c*. The controller 100 compares BtA to β1 at step 410 and initiates the return to dig function at step 420 if BtA is not equal to β1. The controller 100 then enters a return to dig mode and generates controller bucket command signals 102 at step 420 to drive the bucket 36 to β1. The controller 100 then checks to tee see if the joystick 21 has returned to the neutral position 21*c* and moved out of neutral in the direction of detent positions 21*d* or 21*e* at step 430. If the answer is yes, the controller 100 resumes the manual command mode at step 435. If the answer is no, the controller 100 then checks to see if the bucket 36 is dumping at step 440. If the bucket 36 is dumping at step 440, i.e., the BtA is increasing, the controller 100 determines if a first equation $BtA \leqq \beta 1 + 10°$ is true at step 440. If the first equation is not true then the controller bucket command signals 103 are sent to the bucket electrohydraulic circuit 61 at step 455 and the process starts over at step 430. If the first equation is true, then, at step 460, the controller boom command signals 103 are lowered as a function of X, where X is the distance of the boom 31 from the target β1 at step 450. In this particular embodiment, the boom command equals $X^{0.75}$+Offset, where Offset represents a minimum command at the end of any automatic function of the loader assembly 30. The controller 100 then checks to see a second equation, $BtA \approx \beta 1$, is true at step 470. If the second equation is not true, then the controller 100 sends the lowered command signal to the bucket electrohydraulic circuit 61 at step 455 and starts the process over at step 430. If the second equation is true, the controller 100 resumes the manual command mode at step 480.

If, at step 440, the controller 100 determines that the bucket 36 is curling, i.e., BtA is decreasing, the controller determines whether a third equation $BtA \geqq \beta 1 - 10°$ is true at step 445. If the third equation is not true then the controller bucket command signals 103 are sent to the bucket electrohydraulic circuit 61 at step 455 and the process is restarted at step 430. If the third equation is true, then, the process is moved to step 460 and proceeds as described above.

In this embodiment the 10° values in the above relationships are cushion start angles. The cushion start angles could be set at any values.

If return to carry and return to dig are executed such that they are both functioning at the same time, the controller 100 may reduce the controller boom command signals 103 to allow a completion of return to dig prior to a completion of return to carry to prevent the bucket 36 from contacting the ground at a wrong angle.

Anti-Spill

Anti-spill is an automatic bucket control feature that restricts the bucket 36 from being curled past a predetermined bucket to frame position $\alpha_{ata}$ once a predetermined boom to frame position $BmA_{ata}$ is realized or exceeded. The purpose of this feature is to prevent the spilling of material in the bucket 36 onto the hood 21 or the cab 20 of the vehicle 10. When anti-spill is activated the controller 100 will override any function, including, inter alia, parallel lift and return to dig when that function demands a bucket to frame position a curled past the predetermined bucket to frame position $\alpha_{ata}$ and adjusts the bucket 36 in the dumping direction when the boom is raised beyond $BmA_{ata}$, i.e., within the anti-spill zone. In this particular embodiment, the controller 100 generates controller bucket command signals 103 to drive the bucket 36 to the anti-spill target angle $\alpha_{ata}$., i.e., to adjust the bucket 36 to a position such that $\alpha \approx \alpha_{ata}$. The controller 100 suspends this process only when: (1) the boom 31 is no longer moving; (2) the boom 31 is adjusted downwardly while still in the anti-spill zone; (3) the boom 31 is outside of the anti-spill zone; or (4) the operator manipulates the joystick 21 to generate a bucket command signal 29 to dump.

Figure 13:
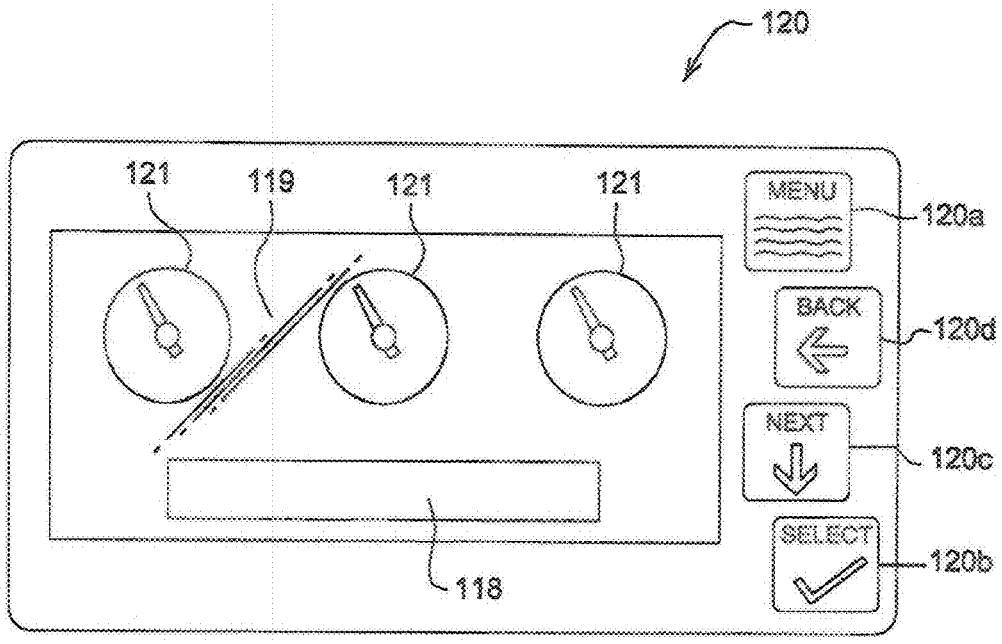
FIG. 13 illustrates a monitor used for anti-spill settings.

$BmA_{ata}$ and $\alpha_{ata}$ are separately set via menu selections using buttons 120*a*, 120*b*, 120*c*, 120*d* and the screen 118 on the monitor 120 illustrated in FIG. 13. However, anti-spill target setting may be accomplished by any appropriate and well-known conventional means such as, for example, separate button switches or multi-function button switches. Regardless of how the predetermined angles $BmA_{ata}$ and $\alpha_{ata}$ are set, anti-spill is a feature that is activated when the vehicle 10 is powered up.

Figure 12:
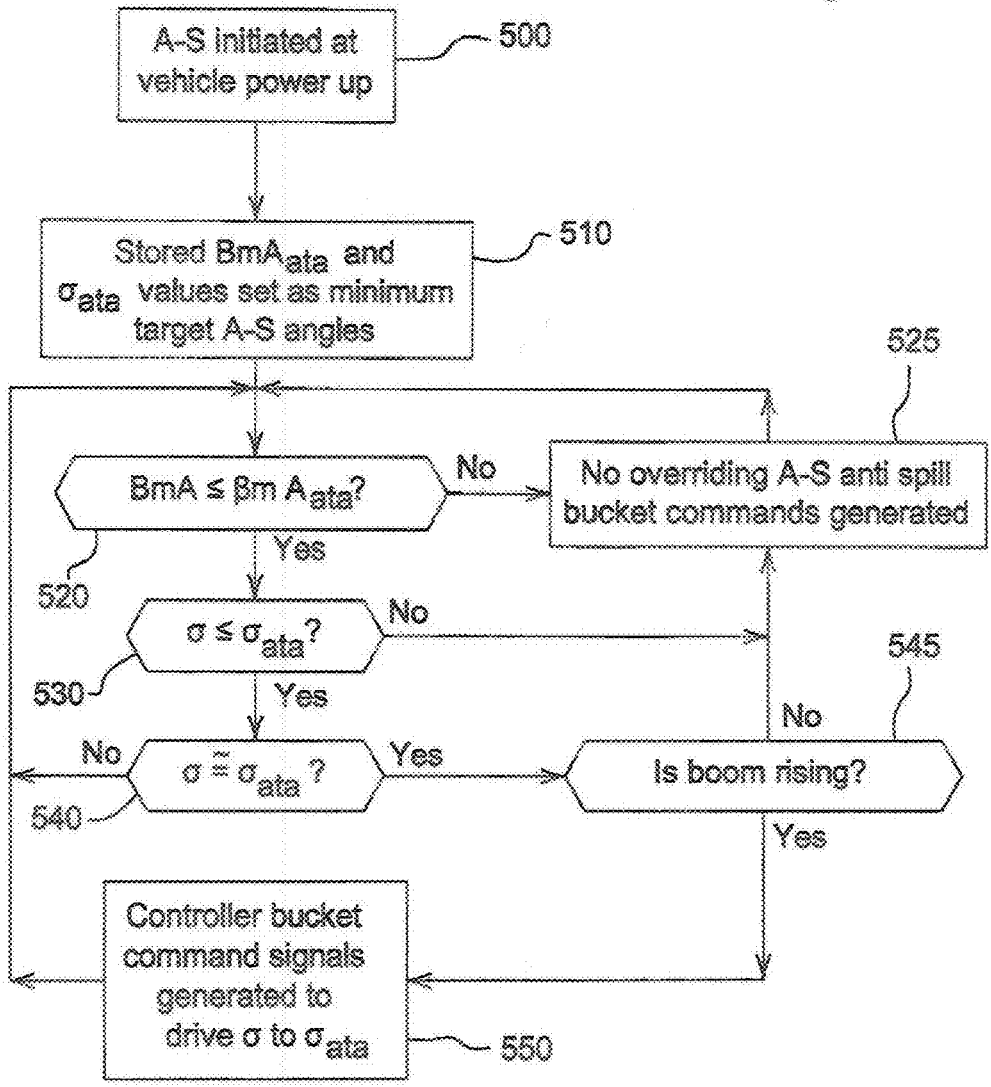
FIG. 12 illustrates the operation of the anti-spill function.

FIG. 12 illustrates the operation of the anti-spill function in a more detailed and visual manner. As illustrated in FIG. 12, the anti-spill function begins when the vehicle 10 is powered up at step 500, at which point the controller 100, at step 510, sets $BmA_{ata}$ and $\alpha_{ata}$ as minimum target angles whether these predetermined angles are factory settings or custom settings by the operator. The controller 100 then determines if a first anti-spill relationship $BmA \leqq BmA_{ata}$ is true at step 520. If the first anti-spill equation is not true, no overriding anti-spill bucket commands are generated and the controller 100 makes another determination on the first anti-spill equation, at step 520, at the next sample time which is determined by a predetermined sample rate. If the first anti-spill relationship is true, the controller 100 determines whether a second anti-spill relationship, $\alpha \leqq \alpha_{ata}$ is true at step 530. If the second anti-spill relationship is not true, no overriding anti-spill bucket commands are generated and the controller 100 begins the process again by determining whether the first anti-spill equation is true at step 520. Once the controller 100 determines that the first and second anti-spill equations are true at steps 520 and 530, the controller determines whether the controller 100 boom command signal 103 is commanding a decrease in BmA, i.e., determines whether BmA is decreasing. If BmA is not decreasing, no overriding anti-spill bucket commands are generated and the controller 100 returns to step 520 to determine whether the first anti-spill relationship is true at the next sample time. Once the controller 100 determines that the first and second anti-spill relationships are true at steps 520 and 530 and that BmA is decreasing at step 540, i.e., the boom 31 is rising, the controller 100, at step 550, generates controller bucket command signals 102 to drive the bucket 36 to $\alpha_{ata}$ and repeats the entire process again starting at step 520 at the next sample time.

The illustration in FIG. 12 demonstrates that the controller 100 will override any bucket commands once the conditions for the anti-spill function are met. Thus, if the operator is curling the bucket 36 past $\alpha_{ata}$ after the boom 31 enters the anti-spill zone, the controller 100 will generate controller bucket command signals 102 to drive the bucket 36 to $\alpha_{ata}$. Further, if the bucket 36 is being dumped via parallel lift when the boom enters the anti-spill zone and the bucket to frame angle α is less than $\alpha_{ata}$, the controller 100 will override parallel lift and generate controller bucket command signals 102 to drive the bucket 36 to $\alpha_{ata}$. Finally, if the boom 31 is within the anti-spill zone the and bucket to frame angle α is, for any reason, less than or equal to $\alpha_{ata}$, the controller 100 will override parallel lift and generate controller bucket command signals 102 to drive the bucket 36 to $\alpha_{ata}$.

Figure 14:
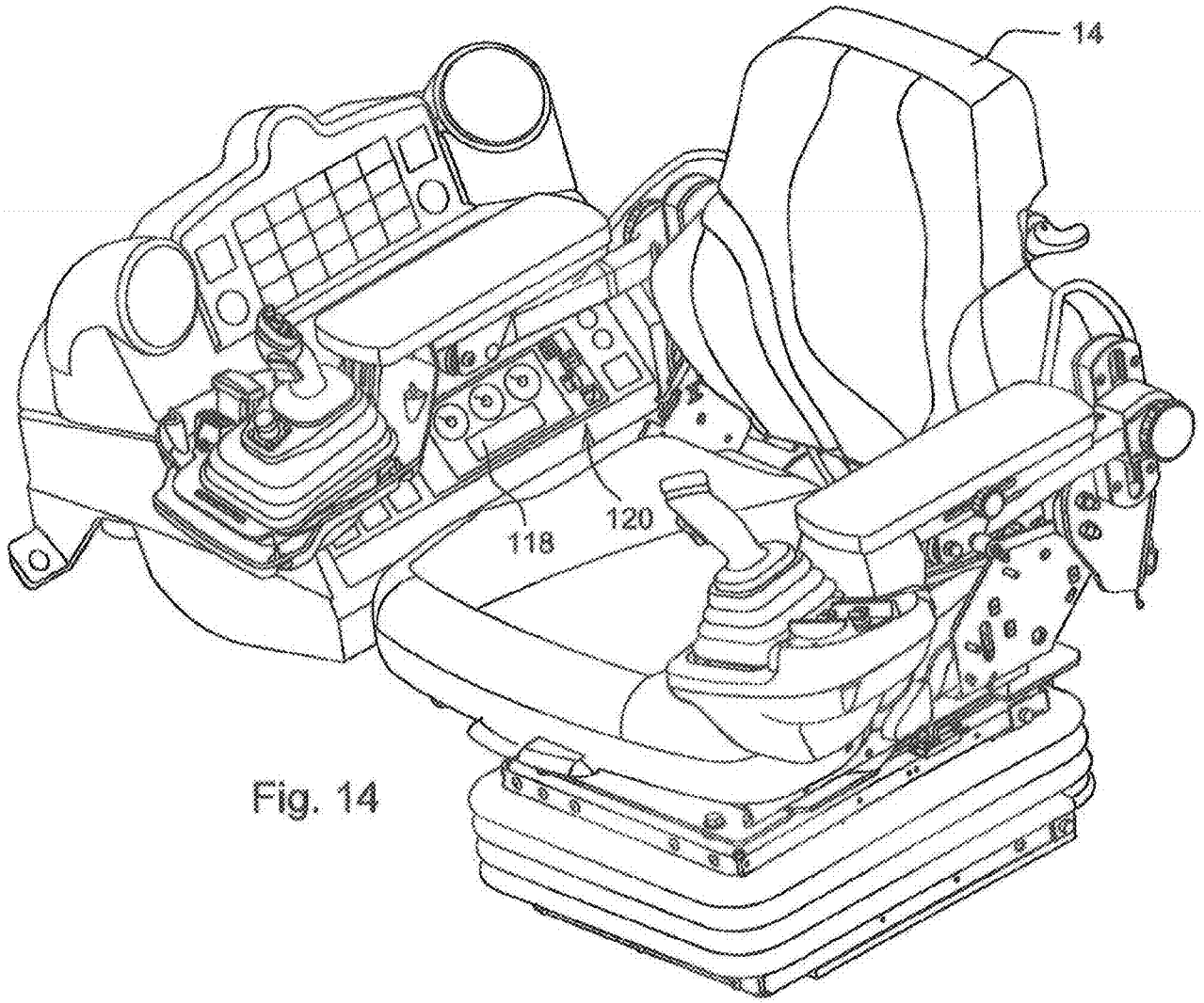
FIG. 14 illustrates a backhoe loader chair 14 showing the position of the monitor in FIG. 13.

In this particular embodiment, $BmA_{ata}$ may be set only when the BmA is between −6° and +20° and $\alpha_{ata}$ maybe set only when the bucket angle $\alpha$ is between +6° and +17°. Successful or unsuccessful target setting is indicated by an audible signal and/or a message via the monitor 120 illustrated in FIGS. 13 and 14. Unsuccessful target setting may be indicated on a display in words such as, for example, "Out of Range" on the monitor screen 118. If no custom targets are set by the operator, the anti-spill function uses factory set targets.

Alternate Embodiment of the Invention

Figure 15:
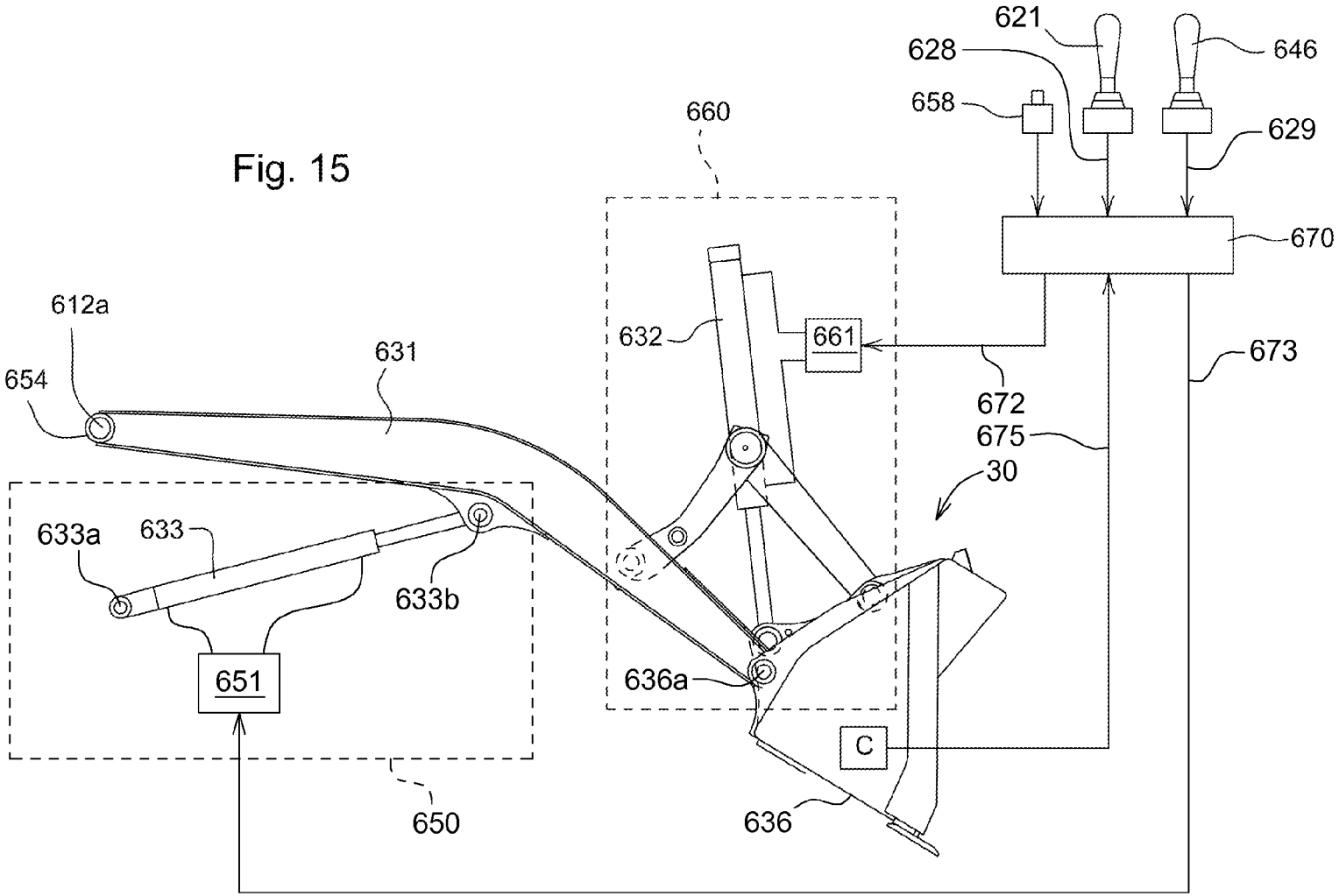
FIG. 15 illustrates a schematic of an alternate embodiment of the components of the invention.

FIG. 15 illustrates a schematic representing an alternate exemplary embodiment of the invention. In FIG. 15, a loader boom actuator 650 includes a loader boom hydraulic cylinder 633 extending between a vehicle frame and the loader boom 631, for controllably moving the loader boom 631 about the loader boom pivot 612*a*. The loader boom hydraulic cylinder 633 is pivotally attached to the frame at a first loader boom hydraulic cylinder pivot 633*a* and pivotally attached to the loader boom 631 at a second loader boom hydraulic cylinder pivot 633*b*.

A loader bucket actuator 660 includes a loader bucket hydraulic cylinder 632 extending between the loader boom 631 and a loader bucket 636 and controllably moves the loader bucket 636 about a loader bucket pivot 636*a*. In the illustrated embodiment, the loader bucket actuator 660 comprises a bucket electro-hydraulic circuit 661 hydraulically coupled to the loader bucket hydraulic cylinder 632. A controller 670 controls the bucket electro-hydraulic circuit 661 which supplies and controls the flow of hydraulic fluid to the loader bucket hydraulic cylinder 632. Note that the bucket hydraulic circuit 661 is conventionally configured.

The operator commands movement of the loader assembly 30 by manipulating a loader bucket command input device such as, for example a joystick 621 and a loader boom command input device such as, for example a joystick 646. The joystick 621 is adapted to generate a loader bucket command signal 628 in proportion to a degree of manipulation by the operator and proportional to a flow rate of fluid to the bucket hydraulic cylinder 632 which is directly proportional to an angular speed of a desired loader bucket movement. The controller 670, in communication with the loader bucket command input device, i.e., joystick 621 and loader bucket actuator 660, receives the loader bucket command signal 628 and responds by generating a controller bucket command signal 672 proportional to the bucket command signal 628, which is received by the loader bucket electro-hydraulic circuit 661. The loader bucket electro-hydraulic circuit 661 responds to the controller bucket command signal 672 by directing hydraulic fluid to and from the loader bucket hydraulic cylinder 632, causing the hydraulic cylinder 632 to extend and retract and curl and dump the loader bucket 636 accordingly.

The joystick 646 is adapted to generate a loader boom command signal 629 in proportion to a degree of manipulation in a first direction of the joystick 646 by the operator, the boom command signal 629 being proportional to a flow rate of fluid to the hydraulic boom cylinder 633 and directly proportional to a speed of a desired loader boom movement. The controller 670, in communication with the joystick 646 and loader boom cylinder 633, receives the loader boom command signal 629 and responds by generating a controller boom command signal 673 proportional to the loader boom command signal 629, which is then used conventionally by a boom hydraulic circuit 651 to adjust the length of the hydraulic boom cylinder 631.

In this embodiment, the controller 670 uses angular signals 675 from a tilt sensor C to determine the angle of the bucket with respect to the ground $\alpha_{ground}$ to execute the parallel lift function.

Having described the illustrated embodiment, it will become apparent that various modifications can be made without departing from the scope of the invention as defined in the accompanying claims. One such modification would be the addition of a tilt sensor to the frame 12 of the vehicle 10. This would allow all angular signals to reference the earth as well as the frame 12.

The invention claimed is:

1. A backhoe loader, comprising:

a frame;

a boom having a first boom end and a second boom end, the first boom end being attached to the frame for establishing a boom pivot about which the boom pivots vertically relative to the frame;

an electrically responsive boom actuator including a hydraulic boom cylinder connected between the frame and boom for selectively pivoting the boom vertically about said boom pivot;

a loader boom command input device selectively manually movable in opposite first and second directions for respectively initiating control of the boom actuator for effecting raising and lowering adjustments of the boom relative to the frame that are proportional to the amount of movement of the loader boom command input device;

a loader boom angle sensor located for sensing angular positions of the boom relative to the frame as the boom moves vertically and for generating boom angle signals respectively representing the angular positions;

a tool being attached to the second boom end for establishing a tool pivot about which the tool pivots vertically relative to the second boom end for performing a work function;

an electrically responsive tool actuator including a hydraulic tool cylinder coupled to the tool for selectively pivoting the tool relative to the second boom end;

at least one tool angle sensor for sensing an angular relationship of said tool with respect to the frame and for generating an electrical tool angle signal representing the sensed angular relationship;

a loader tool command input device selectively manually movable in opposite first and second directions from a neutral position for respectively pivoting the tool relative to the second boom end for effecting angular adjustments proportional to the amount of movement of the loader tool command input device from said neutral position, with said loader tool command input device being selectively movable to a first detent position at an end of its movement from the neutral position wherein it generates a first detent signal;

an electrically responsive controller connected for receiving electrical command input signals from the loader boom and loader tool command input devices, for receiving electrical boom angle and tool angle signals respectively generated by said boom angle sensor and said at least one tool angle sensor and for sending electrical controller boom and bucket command signals to the electrically responsive boom and tool actuators, these command signals respectively being proportional to the signals respectively received from the loader boom and tool command input devices and proportional to the boom angle and tool angle signals respectively received from the boom angle sensor and at least one tool angle sensor;

an electronic signal device being coupled to the controller and being selectively operable for effecting the recording of a first predetermined boom to frame angle resulting from a boom position commanded by an operator by moving the loader boom command input device to a desired position, this recorded boom to frame angle being a predetermined return to carry angle;

said controller being configured for effecting automatic movement of the loader boom to said predetermined return to carry angle by moving said loader tool command input device to said first detent position wherein it generates a first detent command signal which is sent to the controller which responds by comparing a current boom to frame angle to said predetermined boom to frame angle;

said controller further being configured such that if said loader tool command input device is moved to said first detent position when the boom is at or below said predetermined boom to frame angle, the controller executes a float function by sending boom and tool command signals to said boom and tool actuators for causing said boom and bucket hydraulic cylinders to be placed in respective float conditions allowing the boom and tool to gravitate downwardly so that the tool rests on the ground with the boom and tool then following ground contours as the backhoe loader moves over the ground.

2. The backhoe loader of claim 1, wherein the controller has a first mode enabling the controller to receive tool command signals while ignoring tool angle signals, and a second mode enabling the controller to respond to tool angle signals, and further comprising:

a mode switch, the mode switch having a first state and a second state, the first state placing the controller in the first mode, the second state placing the controller in the second mode.

3. The backhoe loader of claim 2, wherein, a movement of the loader tool command input device to any position between the first detent position and the neutral position prior to the boom reaching the first predetermined boom to frame angle returns the controller to the first mode, thereby cancelling the return to carry command signals, whereby control of the boom is then accomplished by manually positioning the loader boom command input device.

4. The backhoe loader of claim 1, wherein the loader tool command input device is an electronic joystick.

5. The backhoe loader of claim 4, wherein the first and second directions are respectively achieved by fore and aft movement of the electronic joystick.

6. The backhoe loader of claim 1, wherein the tool actuator comprises a hydraulic circuit, a hydraulic to cylinder and a linkage, the linkage being operatively coupled to the hydraulic tool cylinder and the tool, the linkage and the hydraulic cylinder manipulating the tool as the hydraulic tool cylinder extends and retracts.

7. The backhoe loader of claim 2, wherein the controller, when in said second mode, lowers the controller boom command signals to the boom actuator as a function of X where X is the distance between a current boom to frame angle and the first predetermined boom to frame angle when the current boom angle is higher than the first predetermined boom to frame angle and at least one of equal to the first predetermined boom to frame angle plus a cushion start angle and less than the first predetermined boom to frame angle plus the cushion start angle.

8. The backhoe loader of claim 7, wherein the controller lowers the controller command signals to the boom actuator by multiplying them by $X^{0.75}$ when the cushion start angle is 10°.

9. The backhoe loader of claim 1, wherein returning the loader tool command input device to the neutral position subsequent to the movement of the loader tool command input device to the first detent position resumes the return to carry command signal enabling the controller to drive the boom to the predetermined return to carry angle, via controller command signals, and to stop the controller command signals when the boom reaches the first predetermined boom to frame angle.

* * * * *